US010942004B2

(12) United States Patent
Grenier

(10) Patent No.: US 10,942,004 B2
(45) Date of Patent: Mar. 9, 2021

(54) HANDLE FOR HOLDING A WEAPON AND WEAPON COMPRISING SUCH A HANDLE

(71) Applicant: SAFRAN ELECTRONICS & DEFENSE, Boulogne Billancourt (FR)

(72) Inventor: Jordane Grenier, Boulogne Billancourt (FR)

(73) Assignee: SAFRAN ELECTRONICS & DEFENSE, Boulogne-Billancourt (FR)

( * ) Notice: Subject to any disclaimer, the term of this patent is extended or adjusted under 35 U.S.C. 154(b) by 0 days.

(21) Appl. No.: 16/603,510

(22) PCT Filed: Apr. 17, 2018

(86) PCT No.: PCT/EP2018/059797
§ 371 (c)(1),
(2) Date: Oct. 7, 2019

(87) PCT Pub. No.: WO2018/197270
PCT Pub. Date: Nov. 1, 2018

(65) Prior Publication Data

US 2020/0041226 A1 Feb. 6, 2020

(30) Foreign Application Priority Data

Apr. 25, 2017 (FR) ..... 17 53604

(51) Int. Cl.
*F41A 23/16* (2006.01)
*F41C 23/16* (2006.01)
*F41C 23/14* (2006.01)

(52) U.S. Cl.
CPC ..... *F41C 23/16* (2013.01); *F41C 23/14* (2013.01)

(58) Field of Classification Search
CPC ..... F41C 23/04; F41C 23/06; F41C 23/08; F41C 23/10; F41C 23/14; F41C 23/16; F41A 23/04; F41A 23/06; F41A 23/08; F41A 23/10
USPC ..... 42/73, 85, 71.01
See application file for complete search history.

(56) References Cited

U.S. PATENT DOCUMENTS 4,502,238 A * 3/1985 Farrar ..... F41A 35/06 42/71.02
6,487,807 B1 * 12/2002 Kopman ..... F41A 23/12 42/72
6,622,416 B2 * 9/2003 Kim ..... F41G 1/35 362/110
7,191,557 B2 * 3/2007 Gablowski ..... F41C 23/16 42/72
7,322,142 B1 * 1/2008 Leung ..... F41C 23/04 42/71.01

(Continued)

*Primary Examiner* — Derrick R Morgan
(74) *Attorney, Agent, or Firm* — Muncy, Geissler, Olds and Lowe, P.C.

(57) ABSTRACT

The invention relates to a weapon front handle, the handle extending along a given axis and comprising a plate for securing to a weapon and a grip for gripping the handle, which grip is connected to the plate and shaped to present grooves for receiving a user's fingers, the handle wherein the grip is connected to the plate in such a manner as to be mounted to pivot relative to the plate about the given axis, the handle including at least one latch for temporarily blocking pivoting of the grip relative to the date about the given axis. The invention also relates to a weapon including such a front handle.

8 Claims, 5 Drawing Sheets

(56) References Cited

U.S. PATENT DOCUMENTS 7,685,761 B2 * 3/2010 Wu ..... F41G 1/35 362/110
8,091,265 B1 * 1/2012 Teetzel ..... F41C 23/16 42/124
8,109,032 B2 * 2/2012 Faifer ..... F41C 23/16 362/110
8,215,047 B2 * 7/2012 Ash, Jr. ..... F41C 23/16 42/71.01
9,010,008 B2 * 4/2015 Hovey ..... F41C 23/16 42/72
9,441,910 B1 * 9/2016 Fogoros ..... F41C 23/14
9,599,429 B1 * 3/2017 Davis ..... F41C 23/10
9,709,356 B1 * 7/2017 Anstett ..... F41C 23/16
10,527,387 B1 * 1/2020 Oliva Chavez ..... F41C 27/00
2002/0100204 A1 * 8/2002 Kim ..... F41G 1/35 42/146
2005/0188588 A1 * 9/2005 Keng ..... F41A 23/10 42/72
2006/0064913 A1 * 3/2006 Gablowski ..... F41C 23/16 42/72
2006/0191183 A1 * 8/2006 Griffin ..... F41C 23/16 42/72
2006/0194173 A1 * 8/2006 Lavigna ..... F41C 23/16 434/16
2008/0010890 A1 * 1/2008 Vice ..... F41C 23/16 42/72
2009/0140015 A1 * 6/2009 Faifer ..... G03B 17/563 224/191
2009/0178325 A1 * 7/2009 Veilleux ..... F41G 1/36 42/117
2009/0193702 A1 * 8/2009 Lin ..... F41C 23/16 42/72
2009/0313873 A1 * 12/2009 Roth ..... F41C 23/16 42/72
2010/0031551 A1 * 2/2010 Griffin ..... F41C 23/16 42/72
2010/0031552 A1 * 2/2010 Houde-Walter ..... F41C 23/16 42/72
2010/0205795 A1 * 8/2010 Moody ..... F41A 23/08 29/428
2011/0047850 A1 3/2011 Rievley et al.
2011/0047851 A1 * 3/2011 Mock ..... F41G 1/35 42/72
2011/0179688 A1 * 7/2011 Ash, Jr. ..... F41C 23/16 42/72
2012/0055061 A1 * 3/2012 Hartley ..... F41C 23/16 42/84
2012/0272557 A1 * 11/2012 Yan ..... F41C 23/16 42/69.01
2013/0014736 A1 * 1/2013 Risicato ..... F41C 23/16 124/80
2013/0239450 A1 * 9/2013 Michel ..... F41C 23/10 42/73
2013/0333263 A1 * 12/2013 Hovey ..... F41C 23/16 42/72
2013/0340312 A1 * 12/2013 Fulton ..... F41C 23/14 42/73
2014/0215884 A1 * 8/2014 Adcock, Jr. ..... F41C 27/16 42/72
2014/0338245 A1 * 11/2014 Lanasa ..... F41C 23/16 42/72
2015/0041538 A1 * 2/2015 Teetzel ..... F41G 1/36 235/404
2015/0198408 A1 * 7/2015 Kincel ..... F41C 23/16 42/72
2016/0003576 A1 * 1/2016 Spykerman ..... F41C 23/14 42/73
2016/0116252 A1 * 4/2016 Kincel ..... F41G 11/004 42/90
2016/0202017 A1 * 7/2016 Corbet ..... B25G 1/102 42/71.01
2016/0245616 A1 * 8/2016 Derousse ..... F41C 23/16
2016/0327371 A1 * 11/2016 Teetzel ..... F41G 11/003
2016/0332290 A1 * 11/2016 Azhocar ..... F16M 11/14
2017/0097208 A1 * 4/2017 Hebden ..... F41C 23/16
2017/0191792 A1 * 7/2017 Holmes ..... F41C 23/14
2017/0205202 A1 * 7/2017 Teetzel ..... F41G 11/003
2019/0165343 A1 * 5/2019 Jernigan ..... H01M 2/1022
2019/0257614 A1 * 8/2019 Bofill ..... F41B 5/1403
2019/0308213 A1 * 10/2019 Mispel-Beyer ..... B05B 1/06
2020/0124377 A1 * 4/2020 McPherson ..... F41B 5/10

* cited by examiner

HANDLE FOR HOLDING A WEAPON AND WEAPON COMPRISING SUCH A HANDLE

The invention relates to a weapon front handle.

The invention also relates to a weapon including such a front handle.

TECHNOLOGICAL BACKGROUND OF THE INVENTION

In the field of firearms, it is known to fit firearms with an additional handle, also referred to as a front handle, that is placed at the front of the weapon. As a result, the user can take hold of the weapon with one hand via a rear handle including the trigger for actuating the weapon, and with the other hand via the front handle.

This makes it easier for the user to handle the weapon, and also makes it easier to shoot it.

Nevertheless, the front handle is usually simply in the shape of a cylinder, which is not very ergonomic for the user.

In order to mitigate that drawback and to increase the grip force that can be applied, proposals have been made in particular to shape the front handle so that it presents recesses to facilitate placing the user's fingers.

Nevertheless, users sometimes feel uncomfortable when taking hold of a front handle shaped in that way.

OBJECT OF THE INVENTION

An object of the invention is to propose a weapon front handle that is more ergonomic.

Another object of the invention is to propose a weapon including such a front handle.

BRIEF DESCRIPTION OF THE INVENTION

In order to achieve this object, there is provided a weapon front handle, the handle extending along a given axis and comprising a plate for securing to a weapon and a grip for gripping the handle, which grip is connected to the plate and shaped to present grooves for receiving a user's fingers.

According to the invention, the grip is connected to the plate in such a manner as to be mounted to pivot relative to the plate about the given axis, the handle including at least one latch for temporarily blocking pivoting of the grip relative to the plate about the given axis.

Thus, the relative angular position about the given axis between the grip and the plate can be modified by the user in order to adapt the positioning of the grooves in the most appropriate manner. In particular, it is thus possible for the grip not to be placed symmetrically relative to the plate about the given axis, should the user prefer such positioning.

A user can thus arrange the grip in appropriate manner relative to a working axis for the forces exerted by the fingers of the user's hand, depending on the weight of the weapon in question, on the recoil of the weapon in question when shooting, on the way in which the user holds the weapon, . . . .

In advantageous manner, the handle is found to be equally usable by left-handers and by right-handers.

The handle of the invention is thus found to be particularly ergonomic.

It should be observed that the handle of the invention is indeed an additional handle fitted to the front of the weapon in order to facilitate taking hold of the weapon, and under no circumstances is it the rear handle of the weapon that includes the trigger.

In particular manner, the handle includes a control ring arranged between the plate and the grip and mounted to pivot relative to the plate and to the grip about the given axis, the handle including at least one latch for temporarily blocking pivoting of the control ring relative to the plate and to the grip.

In particular manner, the latch associated with the grip is the same latch as the latch associated with the control ring.

In particular manner, the latch comprises a support rod arranged through the grip and screw fastened to the plate, the latch being movable in translation along the given axis relative to the plate by being tightened and loosened relative to the plate, the grip being driven in translation along the given axis by the latch.

In particular manner, the grip and/or the latch associated with the grip is hollow.

In particular manner, the handle includes a power supply element and/or a control element.

In particular manner, the handle includes a control button.

In particular manner, the control button is mounted on the handle to pivot about an axis of rotation orthogonal to the given axis of rotation of the grip.

The invention also provides a weapon including such a front handle.

In particular manner, the weapon front handle is removably mounted on the weapon.

Other characteristics and advantages of the invention appear on reading the following description of particular, nonlimiting embodiments of the invention.

BRIEF DESCRIPTION OF THE DRAWINGS

The invention can be better understood in the light of the following description given with reference to the accompanying figures, in which.

DETAILED DESCRIPTION OF THE INVENTION

Figure 1:
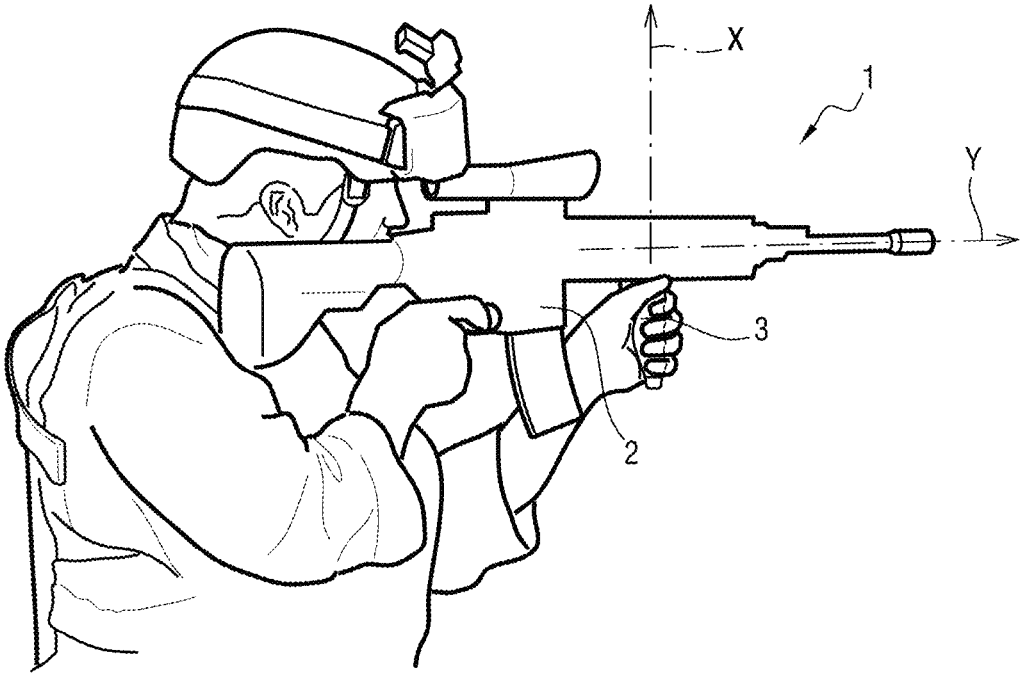
FIG. 1 is a perspective view of a weapon in a particular embodiment of the invention.

With reference to FIG. 1, in a first embodiment of the invention, the weapon, given overall reference 1, includes both a rear handle 2 for actuating the weapon and also a front handle 3, also known as a "foregrip", making it easier for a user to handle the weapon. The front handle 3 is arranged at the front of the weapon 1 and the rear handle 2 at the rear of the weapon 1, with the user, in action, taking hold of the handles in respective hands.

In this example, the front handle 3 is designed to be removably mounted on the weapon 1. Typically, the front handle is designed to be mounted on of the weapon 1 by means of a rail fastener system, in this example of the Picatinny type.

Figure 2:
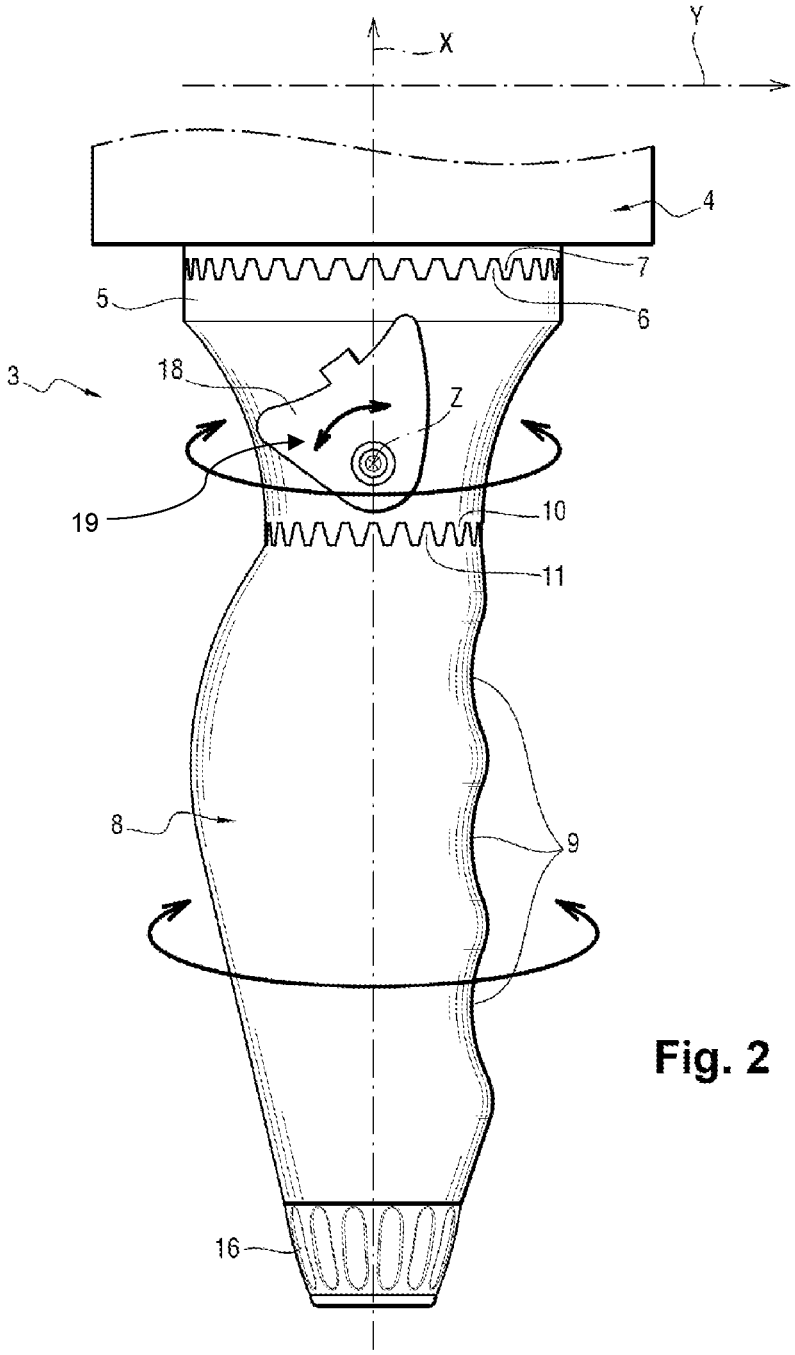
FIG. 2 is a side view of the front handle of the weapon shown in FIG. 1.
Figure 3:
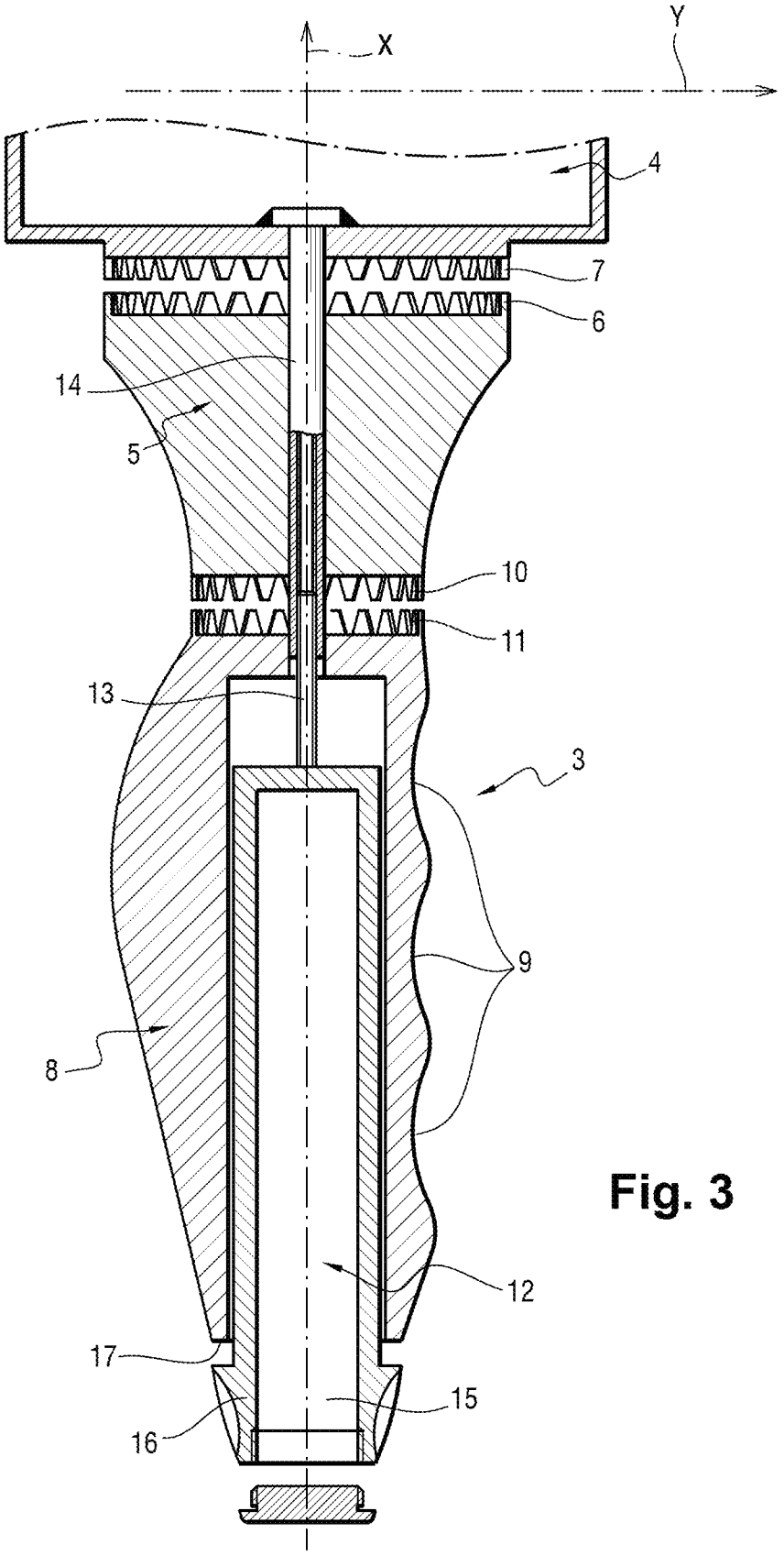
FIG. 3 is a section view of the handle shown in FIG. 2, with the various elements of the handle not being clamped together.

The front handle 3 is described below in greater detail with reference to FIGS. 2 and 3.

The front handle 3 extends generally along an axis X, orthogonal to an axis Y along which the barrel of the weapon extends generally (with the front and the rear of the weapon being specified relative to the axis Y).

The front handle 3 has a plate 4 constituting the portion of the front handle 3 that is mounted on the weapon 1, with this being done in removable manner, as mentioned above.

In particular manner, the front handle 3 includes a control ring 5 that is connected to the plate 4 in such a manner as to be mounted to pivot relative to the plate 4 about the axis X. In this example, the control ring 5 extends immediately under the plate 4. The plate 4 and the control ring 5 are designed to engage temporarily one within the other so as to hold the control ring 5 temporarily stationary relative to the plate 4. Typically, the proximal end 6 of the control ring 5 carries teeth so as to engage in a corresponding toothed portion 7 of the plate 4.

Furthermore, the front handle 3 includes a grip 8 via which the front handle 3 is held. The grip 8 is shaped, e.g. by thermoforming, so as to present grooves 9 for receiving the user's fingers. Typically, said grooves 9 are in the form of mutually parallel recessed zones arranged in the grip 8. In this example, there are three grooves 9.

The grip 8 is connected to the plate 4 so as to be mounted to pivot relative to the plate 4 about the axis X, in this example via the control ring 5. In this example, the grip 8 extends immediately under the control ring 5. The the control ring 5 and the grip 8 are designed to engage temporarily one within the other so as to hold the control ring 5 temporarily stationary relative to the grip 8. Typically, the distal end 10 of the control ring 5 carries teeth so as to engage in a proximal end 11 of the grip 8 that is toothed in corresponding manner.

In order to hold the grip 8 and the control ring 5 temporarily stationary relative to the plate 4, the front handle includes a latch. In this example, said latch comprises a clamping rod 12 that extends inside the grip 8 along the axis X and that is screwed at its proximal end 13 to a support rod 14 that is rigidly fastened to the plate 4 and that extends along the axis X inside the control ring 5 and inside the grip 8.

Screwing the clamping rod 12 into the support rod 14 then causes the clamping rod 12 to rise towards the support rod 14 along the axis X. The clamping rod 12 is thus designed so that it comes into abutment against the grip 8, with its upward movement in translation leading to a corresponding movement of the grip 8. The grip 8 thus ends up engaging with the control ring 5, which in turn engages with the plate 4, thereby completing temporary holding of the grip 8, of the control ring 5, and of the clamping rod 12 stationary relative to the plate 4, until the clamping rod 12 is next loosened. When the grip 8, the control ring 5, and the plate 4 are moved fully towards one another, they engage mutually in one another so as to form a single unit that is rigidly fastened to the weapon 1.

Furthermore, if the user desires to change the position of the control ring 5 and/or of the grip 8 relative to the plate 4, it suffices to loosen the clamping rod 12, to change the angular position of the control ring 5 and/or of the grip 8, and then to tighten the clamping rod 12.

The front handle 3 can thus be adapted simply and quickly to each user.

It should be observed that it is thus possible to modify the relative positions between the various elements of the front handle 3 about the axis X, and to do so over 360°.

The front handle 3 is thus found to be highly adjustable for a user.

Furthermore, as a result of the teeth of the various elements of the front handle 3 preventing rotation, it is ensured that the various elements are held robustly in position relative to one another while the weapon is in use, even though that can lead to vibration, e.g. while firing the weapon.

At its distal end 15, the clamping rod 12 preferably includes a grip knob 16, which in this example is rigidly secured to the clamping rod 12, and which is arranged outside the grip 8 so as to make it easier for the user to manipulate the clamping rod 12. In the present situation, it is this knob 16 that comes into abutment against the corresponding distal end 17 of the grip 8 while the clamping rod 12 is being tightened so as to move the grip 8 in translation along the axis X. This knob 16 thus rests against the distal end 17 of the grip 8 while the grip 8 is temporarily held stationary relative to the control ring 5 and the plate 4.

This knob 16 is preferably not smooth (e.g. it is serrated) so as to make it easier to manipulate.

In preferred manner, the grip 8 and the clamping rod 12 are both hollow, at least over respective portions of the grip and of the clamping rod 12. In this example, the grip 8 and the clamping rod 12 are both hollow over substantially the entire length (along the axis X) respectively of the grip 8 and of the clamping rod 12.

This makes it possible to arrange additional elements (not shown) in the front handle 3, and thus in the grip 8, such as a power supply element (e.g. an optionally rechargeable battery, . . . ), a control element (e.g. an electronic card, a radio transmitter, . . . ) . . . .

By way of example, the clamping rod 12 is closed at its distal end, specifically at the knob 16, by means of a plug in order to give access to the inside of the clamping rod 12.

In a preferred embodiment, the front handle 3 includes at least one control button 18 configured to trigger a command, the control button 18 being remote from the element on which the button command acts. By way of example, this operating button 18 is configured to actuate a radio transmitter arranged inside the clamping rod 12.

Said control button 18 is typically arranged on the control ring 5: because the control ring 5 is movable around the axis X, it is possible for a user to position the control button 18 in an angular position that the user finds comfortable, particularly depending on the length of the user's thumb or on the angle of the user's hand on the front handle 3.

Preferably, the control button 18 is movably mounted on the control ring 5 to turn about a second axis Z that is orthogonal both to the axis X and also to the axis Y along which the weapon extends.

The front handle 3 also includes a latch 19 for temporarily preventing the control button 18 from turning about the axis Z relative to the control ring 5. For example, the control button 18 may be configured to cooperate with snap-fastening abutments of the control ring 5 for temporarily holding the control button 18 stationary in one of its abutment positions. Preferably, in order to prevent the control button 18 accidentally unblocking while the weapon 1 is in use, the control button 18 is configured to be capable of being turned about the axis Z only while pressure is being exerted on its pivot rod in a manner that is constant (and not spontaneous).

As a result, a user can adapt the position of the control button 18 not only relative to the axis X but also relative to the axis Z. It is thus possible for a user to position the control button 18 in an angular position that the user finds comfortable, in particular depending on whether the user is left-handed or right-handed.

In particular, if the control button 18 presents a curved surface for positioning the user's thumb, the user can adapt the angle of inclination of this curved surface in personalized manner.

It should be observed that it is thus possible to modify the position of the control button 18 relative to the axis X and relative to the axis Z, and to do so over 360° for both axes.

The front handle 3 is thus found to be highly adjustable for a user.

Preferably, the front handle 3 includes a sensor (not shown) associated with the control button 18 in order to determine the position of said control button 18 about the axis Z relative to the control ring 5.

This serves to provide an indication to a control member (optionally included in the front handle 3) concerning the direction in which the control button 18 is being turned and concerning its position relative to the plate 4.

Specifically, it might be necessary to reverse the direction of the command issued by the control button 18 depending on its relative position, e.g. if the control button is a button of the type that is moved up and down in translation.

Figure 4:
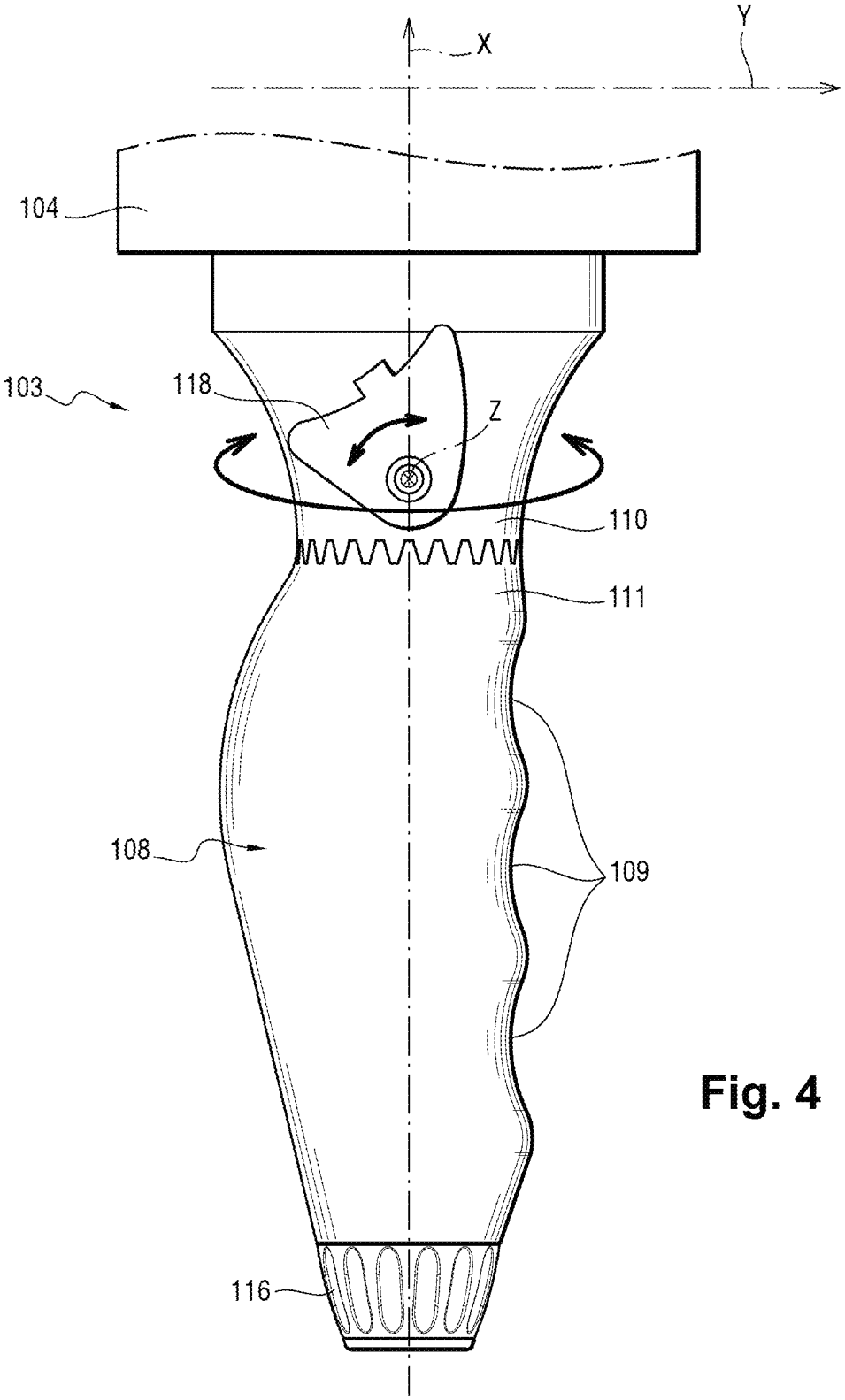
FIG. 4 is a side view of a front handle in a second embodiment of the invention.

With reference to FIG. 4, there follows a description of a second embodiment.

This second embodiment is identical to the first embodiment, except that the front handle 103 no longer includes a control ring.

The grip 108 is thus connected directly to the plate 104 so as to be mounted to pivot relative to the plate 104 about the axis X. In this example, the grip 108 thus extends immediately under the plate 104. The grip 108 and the plate 104 are shaped so as to engage temporarily one within the other so as to hold the grip 108 temporarily stationary relative to the plate 104. Typically, the proximal end 111 of the grip 108 carries teeth so as to engage in a corresponding toothed portion 110 of the plate 104.

Screwing the clamping rod into the support rod then causes the clamping rod to rise towards the support rod along the axis X. The clamping rod is thus designed so that it comes into abutment against the grip 108, with its upward movement in translation leading to a corresponding movement of the grip 108. The grip 108 thus ends up engaging with the plate 104, thereby holding the grip 108 and the clamping rod temporarily stationary relative to the plate 104, until the clamping rod is next loosened. When the grip 108 and the plate 104 are moved fully towards each other, they engage so as to form a single unit that is rigidly fastened to the weapon 101.

In this embodiment, the control button 118 is arranged directly on the plate 104.

The above-described handle 103 can thus be handled equally well by a left-hander or by a right-hander. Specifically, in order to change position, it suffices for a user to carry out the following steps:

- turn the grip 108 relative to the plate 104 about the axis X (the grip 108 is then turned towards the rear handle and no longer towards the barrel of the weapon);
- pivot the control button 118 about the axis Z (the entire handle 103 is then configured in a right-handed or left-handed position, but is turned towards the rear handle); and
- remove the handle 103 from the weapon and re-connect it to the weapon in the opposite direction so that the handle 103 is now turned towards the barrel of the weapon and no longer towards the rear handle.

Thus, a user can adapt the position of the control button 118 not only relative to the axis X but also relative to the axis Z. It is thus possible for a user to position the control button 118 in an angular position that the user finds comfortable, in particular depending on whether the user is left-handed or right-handed.

In particular, this also makes it possible to change the depth of the position of the control button 118 relative to the user. The user can thus adapt the position of the control button 118 also depending on the length of the user's thumb or on the angle of the user's hand on the front handle 103.

This embodiment is simpler than the first embodiment.

Nevertheless, the first embodiment makes it possible to avoid separating the front handle 103 temporarily from the weapon in order to re-connect it in a different direction.

Naturally, the invention is not limited to the embodiment described, and variant embodiments may be provided without going beyond the ambit of the invention as defined by the claims.

In particular, although the front handle is described as being mounted removably on the weapon, the front handle could be fastened to the weapon rigidly and without being removable from the weapon. The plate of the front handle could thus be integral with the remainder of the weapon, or it could be an independent element fitted to the remainder of the weapon and rigidly fastened thereto.

It is also possible to omit the control ring, and thus to arrange the front handle directly under the plate.

The various elements of the front handle may be connected together differently from the above description. For example, it is possible to omit a support rod: the clamping rod would then be screwed directly into a tapped hole formed in the plate.

Although in this example the front handle serves to provide a radio function, the front handle could also provide other types of function, either in addition or as a replacement. The front handle could also have a number of control buttons that is greater than that described above. The control buttons could be carried directly by the grip rather than by the control ring. The front handle could thus provide wireless communication, modify images projected to the user on a screen (e.g. it could control zooming of images projected onto a telescopic sight of the weapon) . . . .

Figure 5:
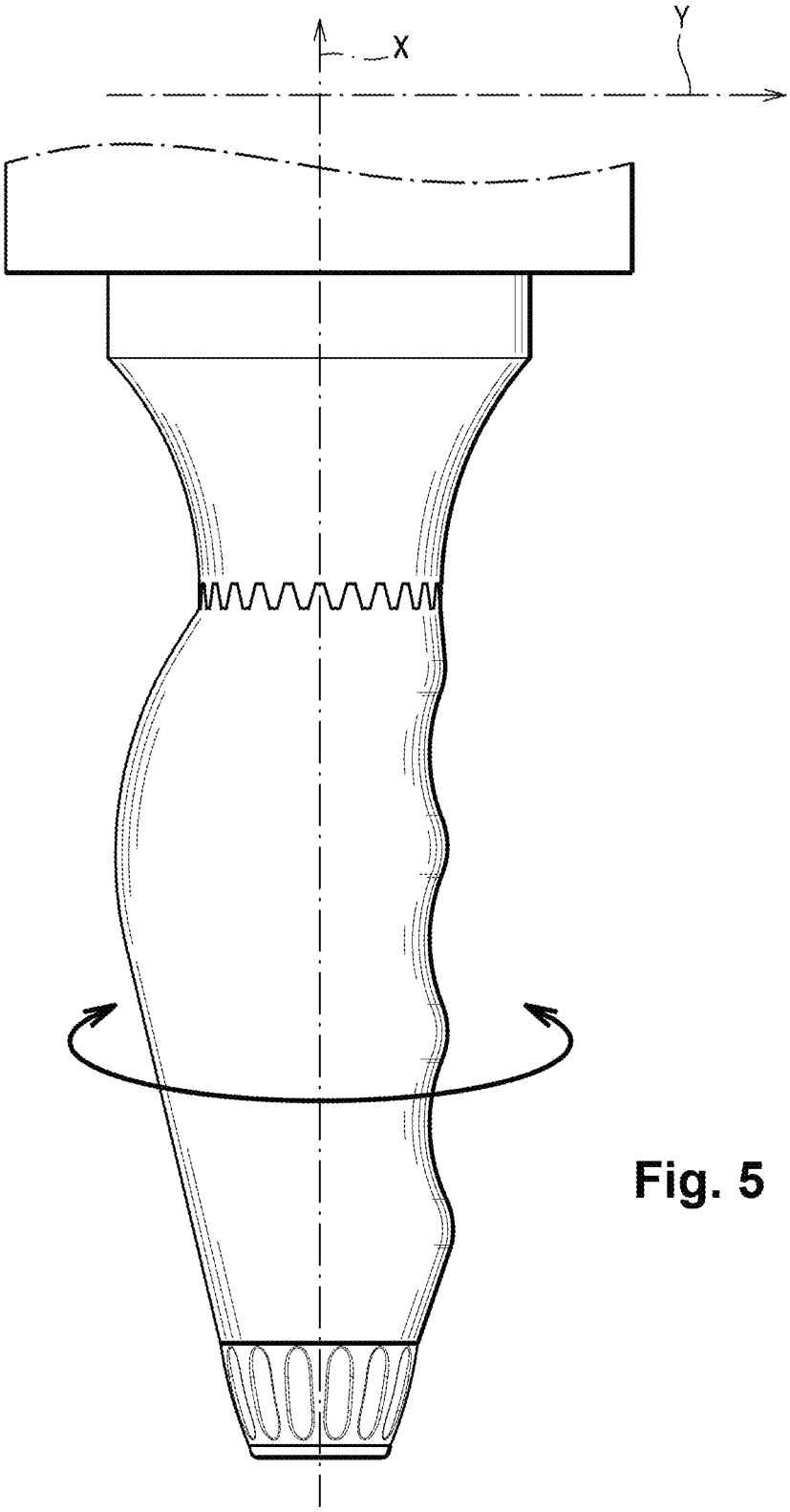
FIG. 5 is a side view of a front handle in a third embodiment of the invention.

It is also possible for the front handle not to include any power supply or controls. FIG. 5 thus shows a third embodiment in which the handle does not include any power supply or controls, and thus does not include any control button.

The invention claimed is:

1. A weapon front handle, the handle extending along a first given axis and comprising a plate for securing to a weapon and a grip for gripping the handle, which grip is connected to the plate and shaped to present grooves for receiving a user's fingers, wherein the grip is connected to the plate in such a manner as to be mounted to pivot relative to the plate about the first given axis, the handle including at least one first latch for temporarily blocking pivoting of the grip relative to the plate about the first given axis, the handle including a control button configured to trigger a command in an additional element remote from the control button, the control button movably mounted on the handle to turn about a second axis of rotation orthogonal both to the first given axis of rotation of the grip and to a third axis along which the weapon extends, the front handle also including a second latch for temporarily blocking turning of the control button about the second axis of rotation, the first given axis being askew to the third axis.

2. The handle according to claim 1, wherein the handle further comprises a control ring arranged between the plate and the grip and mounted to pivot relative to the plate and to the grip about the first given axis, the handle including the at least one first latch for temporarily blocking pivoting of the control ring relative to the plate and to the grip.

3. The handle according to claim 2, wherein the first latch associated with the grip is the same latch as the first latch associated with the control ring.

4. The handle according to claim 1, wherein the first latch comprises a support rod arranged through the grip and screw fastened to the plate, the first latch being movable in translation along the first given axis relative to the plate by being tightened and loosened relative to the plate, the grip being driven in translation along the first given axis by the first latch.

5. The handle according to claim 1, wherein the grip and/or or the latch associated with the grip is hollow.

6. The handle according to claim 1, including a power supply element or a control element.

7. A weapon including a weapon front handle according to claim 1.

8. The weapon according to claim 7, wherein the weapon front handle is removably mounted on the weapon.

* * * * *